US010978267B2

(12) United States Patent
Douglass et al.

(10) Patent No.: US 10,978,267 B2
(45) Date of Patent: Apr. 13, 2021

(54) HIGH VOLTAGE POWER FUSE INCLUDING FATIGUE RESISTANT FUSE ELEMENT AND METHODS OF MAKING THE SAME

(71) Applicant: EATON INTELLIGENT POWER LIMITED, Dublin (IE)

(72) Inventors: Robert Stephen Douglass, Wildwood, MO (US); Ramdev Kanapady, Campbell, CA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/186,674

(22) Filed: Jun. 20, 2016

(65) Prior Publication Data

US 2017/0365434 A1 Dec. 21, 2017

(51) Int. Cl.

| | |
|---|---|
| ***H01H 85/08*** | (2006.01) |
| ***H01H 85/06*** | (2006.01) |
| ***H01H 85/042*** | (2006.01) |
| ***H01H 85/38*** | (2006.01) |
| ***H01H 85/153*** | (2006.01) |

(Continued)

(52) U.S. Cl.

CPC ..... *H01H 85/08* (2013.01); *H01H 85/042* (2013.01); *H01H 85/06* (2013.01); *H01H 85/10* (2013.01); *H01H 85/12* (2013.01); *H01H 85/153* (2013.01); *H01H 85/175* (2013.01); *H01H 85/38* (2013.01); *H01H 69/02* (2013.01); *H01H 85/15* (2013.01); *H01H 85/18* (2013.01); *H01H 2085/383* (2013.01)

(58) Field of Classification Search

CPC ..... H01H 85/08; H01H 85/153; H01H 85/06; H01H 85/175; H01H 85/042; H01H 85/38; H01H 2085/383; H01H 85/10; H01H 85/12; H01H 69/02; H01H 85/15; H01H 85/18

USPC ..... 337/293

See application file for complete search history.

(56) References Cited

U.S. PATENT DOCUMENTS 901,261 A * 10/1908 Reynolds et al. ... H01H 85/046 337/290
2,856,488 A * 10/1958 Kozacka ..... H01H 85/42 337/159

(Continued)

FOREIGN PATENT DOCUMENTS

DE 102012209138 A1 12/2013
DE 102012224223 A1 7/2014

(Continued)

OTHER PUBLICATIONS

International Search Report and Written Opinion for International Application No. PCT/US2017/029763, dated Jul. 27, 2017, 15 pages.

(Continued)

*Primary Examiner* — Anatoly Vortman
(74) *Attorney, Agent, or Firm* — Armstrong Teasdale LLP

(57) ABSTRACT

A power fuse includes a housing, first and second conductive terminals extending from the housing, and at least one fatigue resistant fuse element assembly connected between the first and second terminals. The fuse element assembly includes at least a first conductive plate and a second conductive plate respectively connecting the first and second conductive terminals, and a plurality of separately provided wire bonded weak spots interconnecting the first conductive plate and the second conductive plate.

24 Claims, 11 Drawing Sheets

(51) Int. Cl.

| | |
|---|---|
| ***H01H 85/175*** | (2006.01) |
| ***H01H 85/10*** | (2006.01) |
| ***H01H 85/12*** | (2006.01) |
| *H01H 85/18* | (2006.01) |
| *H01H 85/15* | (2006.01) |
| *H01H 69/02* | (2006.01) |

(56) References Cited

U.S. PATENT DOCUMENTS 3,603,909 A * 9/1971 Salzer ..... H01H 85/055 337/161
3,636,491 A * 1/1972 Cameron ..... H01H 85/303 337/161
3,777,370 A * 12/1973 Wakui ..... H01H 69/02 29/623
4,041,435 A * 8/1977 Gaia ..... H01H 85/10 337/159
4,237,440 A * 12/1980 Miyasaka ..... H01H 85/055 337/227
4,404,536 A * 9/1983 Still ..... H01H 85/0417 337/201
4,626,817 A * 12/1986 Cameron ..... H01H 85/055 337/158
4,689,597 A * 8/1987 Galloway ..... H01H 85/0411 29/623
4,751,489 A * 6/1988 Spaunhorst ..... H01H 85/0417 337/255
4,771,260 A * 9/1988 Gurevich ..... H01H 69/02 337/208
4,869,972 A 9/1989 Hatagishi
4,924,203 A * 5/1990 Gurevich ..... H01H 69/02 337/208
4,994,779 A * 2/1991 Douglass ..... H01H 85/055 337/163
5,086,285 A * 2/1992 Arikawa ..... H01H 85/0411 337/186
5,712,610 A * 1/1998 Takeichi ..... H01H 85/046 29/623
5,736,918 A * 4/1998 Douglass ..... H01H 85/10 337/186
5,770,994 A * 6/1998 Evans ..... H01H 85/10 337/159
5,903,208 A * 5/1999 Sorger ..... H01H 85/38 337/158
6,160,471 A * 12/2000 Rybka ..... H01H 85/055 337/273
6,507,265 B1 * 1/2003 Ackermann ..... H01H 85/10 337/278
2005/0083167 A1 4/2005 Ackermann
2006/0119465 A1 * 6/2006 Dietsch ..... H01H 85/0418 337/186
2009/0108980 A1 * 4/2009 Whitney ..... H01H 37/761 337/161
2010/0164677 A1 7/2010 Yang
2011/0279218 A1 * 11/2011 Salonga ..... H01H 85/08 337/187
2015/0348791 A1 12/2015 Douglass et al.

FOREIGN PATENT DOCUMENTS

| | | | |
|---|---|---|---|
| DE | 102016106361 | A1 | 10/2016 |
| EP | 0962953 | A2 | 12/1999 |
| EP | 2608243 | A1 | 6/2013 |
| JP | 63115053 | A | 10/1978 |
| JP | 581942 | A | 1/1983 |
| JP | S61224233 | A | 10/1986 |
| JP | 0389864 | A | 4/1991 |
| JP | 0757613 | A | 3/1995 |
| JP | 2014054102 | A | 3/2014 |
| WO | 0131311 | A2 | 5/2001 |
| WO | 2015183805 | A1 | 12/2015 |

OTHER PUBLICATIONS

International Search Report and Written Opinion for International Application No. PCT/US2017/029774, dated Jul. 21, 2017, 16 pages.

* cited by examiner

5. Stamp Away Lead Frame

HIGH VOLTAGE POWER FUSE INCLUDING FATIGUE RESISTANT FUSE ELEMENT AND METHODS OF MAKING THE SAME

CROSS REFERENCE TO RELATED APPLICATIONS

This application relates in subject matter to U.S. application Ser. No. 14/289,032 filed May 28, 2014, the complete disclosure of which is hereby incorporated by reference in its entirety.

BACKGROUND OF THE INVENTION

The field of the invention relates generally to electrical circuit protection fuses, and more specifically to the fabrication of power fuses including thermal-mechanical strain fatigue resistant fusible element assemblies.

Fuses are widely used as overcurrent protection devices to prevent costly damage to electrical circuits. Fuse terminals typically form an electrical connection between an electrical power source or power supply and an electrical component or a combination of components arranged in an electrical circuit. One or more fusible links or elements, or a fuse element assembly, is connected between the fuse terminals, so that when electrical current flow through the fuse exceeds a predetermined limit, the fusible elements melt and open one or more circuits through the fuse to prevent electrical component damage.

So-called full-range power fuses are operable in high voltage power distribution systems to safely interrupt both relatively high fault currents and relatively low fault currents with equal effectiveness. In view of constantly expanding variations of electrical power systems, known fuses of this type are disadvantaged in some aspects. Improvements in full-range power fuses are desired to meet the needs of the marketplace.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
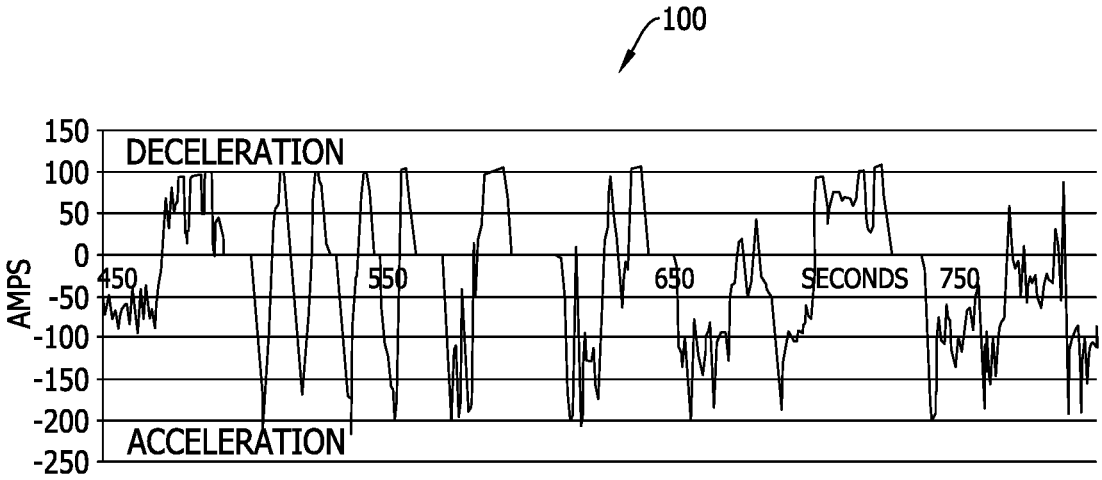
FIG. 1 illustrates an exemplary transient current pulse profile generated in an exemplary electrical power system.

Recent advancements in electric vehicle technologies, among other things, present unique challenges to fuse manufacturers. Electric vehicle manufacturers are seeking fusible circuit protection for electrical power distribution systems operating at voltages much higher than conventional electrical power distribution systems for vehicles, while simultaneously seeking smaller fuses to meet electric vehicle specifications and demands.

Electrical power systems for conventional, internal combustion engine-powered vehicles operate at relatively low voltages, typically at or below about 48 VDC. Electrical power systems for electric-powered vehicles, referred to herein as electric vehicles (EVs), however, operate at much higher voltages. The relatively high voltage systems (e.g., 200 VDC and above) of EVs generally enables the batteries to store more energy from a power source and provide more energy to an electric motor of the vehicle with lower losses (e.g., heat loss) than conventional batteries storing energy at 12 volts or 24 volts used with internal combustion engines, and more recent 48 volt power systems.

EV original equipment manufacturers (OEMs) employ circuit protection fuses to protect electrical loads in all-battery electric vehicles (BEVs), hybrid electric vehicles (HEVs) and plug-in hybrid electric vehicles (PHEVs). Across each EV type, EV manufacturers seek to maximize the mileage range of the EV per battery charge while reducing cost of ownership. Accomplishing these objectives turns on the energy storage and power delivery of the EV system, as well as the size, volume and mass of the vehicle components that are carried by the power system. Smaller and/or lighter vehicles will more effectively meet these demands than larger and heavier vehicles, and as such all EV components are now being scrutinized for potential size, weight, and cost savings.

Generally speaking, larger components tend to have higher associated material costs, tend to increase the overall size of the EV or occupy an undue amount of space in a shrinking vehicle volume, and tend to introduce greater mass that directly reduces the vehicle mileage per single battery charge. Known high voltage circuit protection fuses are, however, relatively large and relatively heavy components. Historically, and for good reason, circuit protection fuses have tended to increase in size to meet the demands of high voltage power systems as opposed to lower voltage systems. As such, existing fuses needed to protect high voltage EV power systems are much larger than the existing fuses needed to protect the lower voltage power systems of conventional, internal combustion engine-powered vehicles. Smaller and lighter high voltage power fuses are desired to meet the needs of EV manufacturers, without sacrificing circuit protection performance.

Electrical power systems for state of the art EVs may operate at voltages as high as 450 VDC. The increased power system voltage desirably delivers more power to the EV per battery charge. Operating conditions of electrical fuses in such high voltage power systems is much more severe, however, than lower voltage systems. Specifically, specifications relating to electrical arcing conditions as the fuse opens can be particularly difficult to meet for higher voltage power systems, especially when coupled with the industry preference for reduction in the size of electrical fuses. Current cycling loads imposed on power fuses by state of the art EVs also tend to impose mechanical strain and wear that can lead to premature failure of a conventional fuse element. While known power fuses are presently available for use by EV OEMs in high voltage circuitry of state of the art EV applications, the size and weight, not to mention the cost, of conventional power fuses capable of meeting the requirements of high voltage power systems for EVs is impractically high for implementation in new EVs.

Providing relatively smaller power fuses that can capably handle high current and high battery voltages of state of the art EV power systems, while still providing acceptable interruption performance as the fuse element operates at high voltages is challenging, to say the least. Fuse manufacturers and EV manufactures would each benefit from smaller, lighter and lower cost fuses. While EV innovations are leading the markets desired for smaller, higher voltage fuses, the trend toward smaller, yet more powerful, electrical systems transcends the EV market. A variety of other power system applications would undoubtedly benefit from smaller fuses that otherwise offer comparable performance to larger, conventionally fabricated fuses. Improvements are needed to longstanding and unfulfilled needs in the art.

Exemplary embodiments of electrical circuit protection fuses are described below that address these and other difficulties. Relative to known high voltage power fuses, the exemplary fuse embodiments advantageously offer relatively smaller and more compact physical package size that, in turn, occupies a reduced physical volume or space in an EV. Also relative to known fuses, the exemplary fuse embodiments advantageously offer a relatively higher power handling capacity, higher voltage operation, full range time-current operation, lower short-circuit let-through energy performance, and longer life operation and reliability. The exemplary fuse embodiments are designed and engineered to provide very high current limiting performance as well as long service life and high reliability from nuisance or premature fuse operation. Method aspects will be in part explicitly discussed and in part apparent from the discussion below.

While described in the context of EV applications and a particular type and ratings of a fuse, the benefits of the invention are not necessarily limited to EV applications or to the particular fuse type or ratings described. Rather the benefits of the invention are believed to more broadly accrue to many different power system applications and can also be practiced in part or in whole to construct different types of fuses having similar or different ratings than those discussed herein.

FIG. 1 illustrates an exemplary current drive profile 100 in an EV power system application that can render a fuse, and specifically the fuse element or elements therein susceptible to load current cycling fatigue. The current is shown along a vertical axis in FIG. 1 with time shown along the horizontal axis. In typical EV power system applications, power fuses are utilized as circuit protection devices to prevent damage to electrical loads from electrical fault conditions. Considering the example of FIG. 1, EV power systems are susceptible to large variance in current loads over relatively short periods of time. The variance in current produces current pulses of various magnitude in sequences produced by seemingly random driving habits based on the actions of the driver of the EV vehicle, traffic conditions and/or road conditions. This creates a practically infinite variety of current loading cycles on the EV drive motor, the primary drive battery, and any protective power fuse included in the system.

Such random current loading conditions, exemplified in the current pulse profile of FIG. 1, are cyclic in nature for both the acceleration of the EV (corresponding to battery drain) and the deceleration of the EV (corresponding to regenerative battery charging). This current cyclic loading imposes thermal cycling stress on the fuse element, and more specifically in the so-called weak spots of the fuse element assembly in the power fuse, by way of a joule effect heating process. This thermal cyclic loading of the fuse element imposes mechanical expansion and contraction cycles on the fuse element weak spots in particular. This repeated mechanical cyclic loading of the fuse element weak spots imposes an accumulating strain that damages the weak spots to the point of breakage in time. For the purposes of the present description, this thermal-mechanical process and phenomena is referred to herein as fuse fatigue. As explained further below, fuse fatigue is attributable mainly to creep strain as the fuse endures the drive profile. Heat generated in the fuse element weak spots is the primary mechanism leading to the onset of fuse fatigue.

Figure 2:
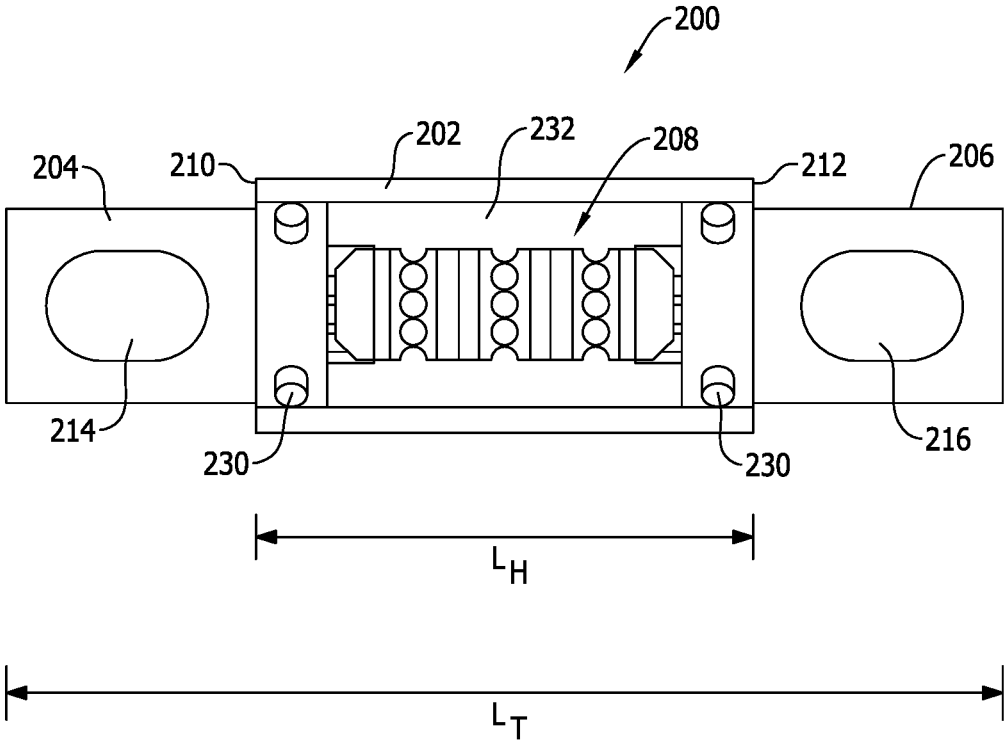
FIG. 2 is a top plan view of a high voltage power fuse that may experience the current profile shown in FIG. 1.
Figure 3:
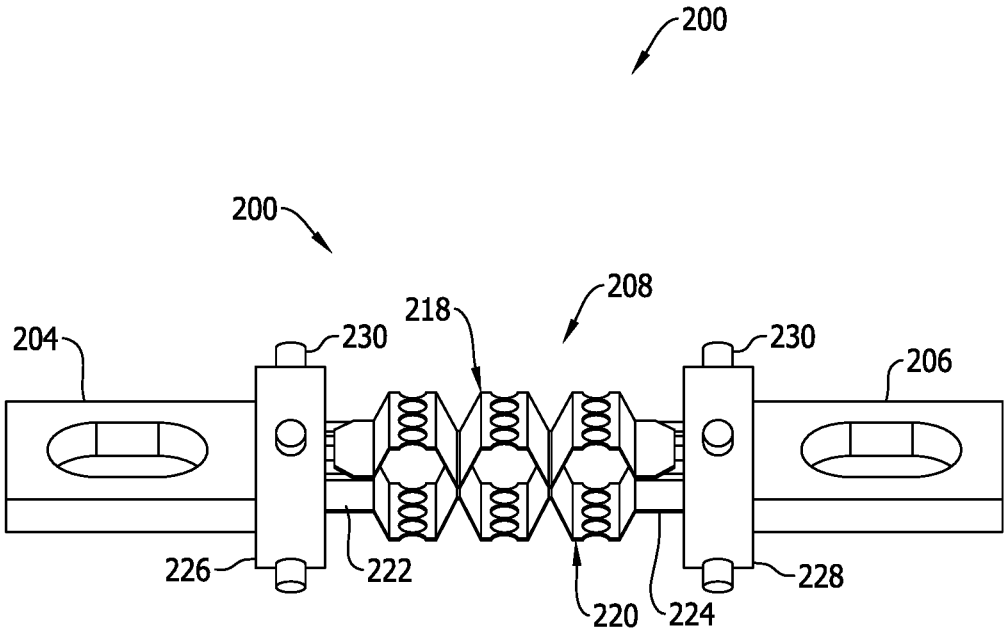
FIG. 3 is a partial perspective view of the power fuse shown in FIG. 2.
Figure 4:
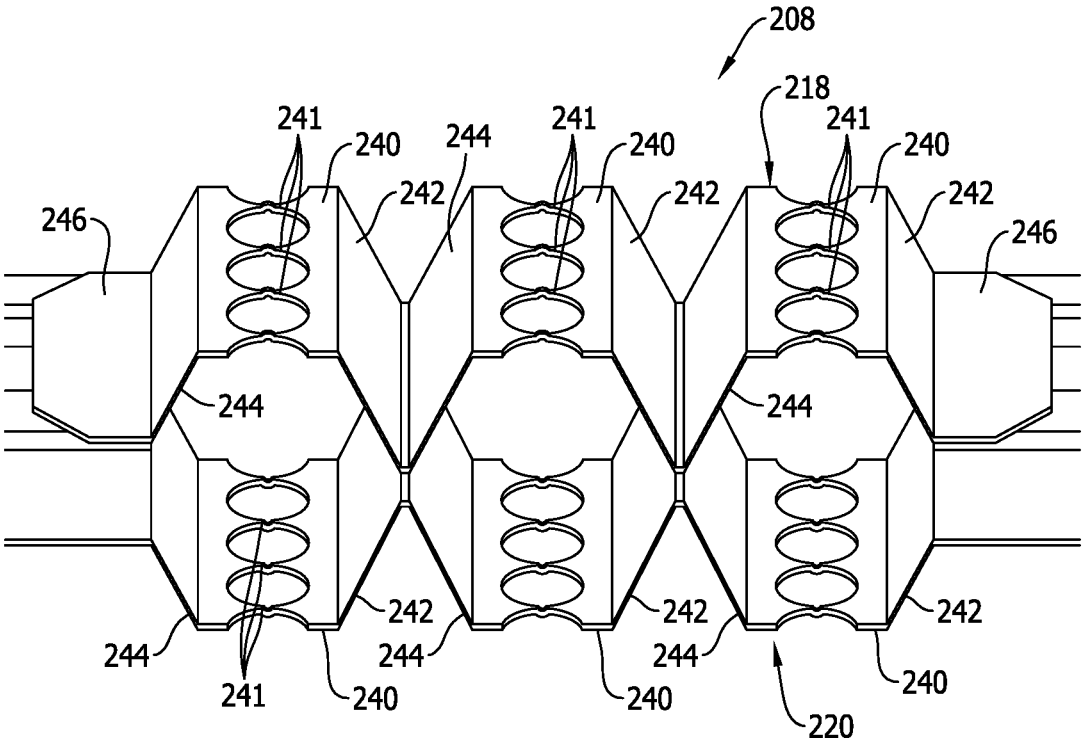
FIG. 4 is an enlarged view of the fuse element assembly shown in FIG. 3.

FIGS. 2-4 are various views of an exemplary high voltage power fuse 200 that is designed for use with an EV power system. Relative to a known UL Class J fuse that is constructed conventionally, the fuse 200 provides comparable performance in a much smaller package size.

As shown in FIG. 2, the power fuse 200 of the invention includes a housing 202, terminal blades 204, 206 configured for connection to line and load side circuitry, and a fuse element assembly 208 that completes an electrical connection between the terminal blades 204, 206. When subjected to predetermined current conditions, at least a portion of the fuse element assembly 208 melts, disintegrates, or otherwise structurally fails and opens the circuit path between the terminal blades 204, 206. Load side circuitry is therefore electrically isolated from the line side circuitry to protect load side circuit components and circuit from damage when electrical fault conditions occur.

The fuse 200 in one example is engineered to provide a voltage rating of 500 VDC and a current rating of 150 A. The dimensions of the fuse 200 in the example shown, wherein $L_H$ is the axial length of the housing of the fuse between its opposing ends, $R_H$ is the outer radius of the housing of the fuse, and $L_T$ is the total overall length of the fuse measured between the distal ends of the blade terminals that oppose one another on opposite sides of the housing, is about 50% of the corresponding dimensions of a known UL Class J fuse offering comparable performance in a conventional construction. Additionally, the radius of the fuse housing 202 is about 50% of the radius of a conventional UL Class J fuse offering comparable performance, and the volume of the fuse 200 is reduced about 87% from the volume of a conventional UL Class J fuse offering comparable performance at the same ratings. Thus, the fuse 200 offers significant size and volume reduction while otherwise offering comparable fuse protection performance to the fuse. The size and volume reduction of the fuse 200 further contributes to weight and cost savings via reduction of the materials utilized in its construction relative to the fuse 100. Accordingly, and because of its smaller dimensions the fuse 200 is much preferred for EV power system applications.

In one example, the housing 202 is fabricated from a non-conductive material known in the art such as glass melamine in one exemplary embodiment. Other known materials suitable for the housing 202 could alternatively be used in other embodiments as desired. Additionally, the housing 202 shown is generally cylindrical or tubular and has a generally circular cross-section along an axis perpendicular to the axial length dimensions $L_H$ and $L_R$ in the exemplary embodiment shown. The housing 202 may alternatively be formed in another shape if desired, however, including but not limited to a rectangular shape having four side walls arranged orthogonally to one another, and hence having a square or rectangular-shaped cross section. The housing 202 as shown includes a first end 210, a second end 212, and an internal bore or passageway between the opposing ends 210, 212 that receives and accommodates the fuse element assembly 208.

In some embodiments the housing 202 may be fabricated from an electrically conductive material if desired, although this would require insulating gaskets and the like to electrically isolate the terminal blades 204, 206 from the housing 202.

The terminal blades 204, 206 respectively extend in opposite directions from each opposing end 210, 212 of the housing 202 and are arranged to extend in a generally co-planar relationship with one another. Each of the terminal blades 204, 206 may be fabricated from an electrically conductive material such as copper or brass in contemplated embodiments. Other known conductive materials may alternatively be used in other embodiments as desired to form the terminal blades 204, 206. Each of the terminal blades 204, 206 is formed with an aperture 214, 216 as shown in FIG. 3, and the apertures 214, 216 may receive a fastener such as a bolt (not shown) to secure the fuse 200 in place in an EV and establish line and load side circuit connections to circuit conductors via the terminal blades 204, 206.

While exemplary terminal blades 204, 206 are shown and described for the fuse 200, other terminal structures and arrangements may likewise be utilized in further and/or alternative embodiments. For example, the apertures 214, 216 may be considered optional in some embodiments and may be omitted. Knife blade contacts may be provided in lieu of the terminal blades as shown, as well as ferrule terminals or end caps as those in the art would appreciate to provide various different types of termination options. The terminal blades 204, 206 may also be arranged in a spaced apart and generally parallel orientation if desired and may project from the housing 202 at different locations than those shown.

As seen in FIG. 3 wherein the housing 202 is removed and in the enlarged view of FIG. 4, the fuse element assembly 208 includes a first fuse element 218 and a second fuse element 220 that each respectively connect to terminal contact blocks 222, 224 provided on end plates 226, 228. The end plates 226, 228 including the blocks 222, 224 are fabricated from an electrically conductive material such as copper, brass or zinc, although other conductive materials are known and may likewise be utilized in other embodiments. Mechanical and electrical connections of the fuse elements 218, 210 and the terminal contact blocks 222, 224 may be established using known techniques, including but not limited to soldering techniques.

In various embodiments, the end plates 226, 228 may be formed to include the terminal blades 204, 206 or the terminal blades 204, 206 may be separately provided and attached. The end plates 226, 228 may be considered optional in some embodiments and connection between the fuse element assembly 208 and the terminal blades 204, 206 may be established in another manner.

A number of fixing pins 230 are also shown that secure the end plates 226, 228 in position relative to the housing 202. The fixing pins 230 in one example may be fabricated from steel, although other materials are known and may be utilized if desired. In some embodiments, the pins 230 may be considered optional and may be omitted in favor of other mechanical connection features.

An arc extinguishing filler medium or material 232 surrounds the fuse element assembly 208. The filler material 232 may be introduced to the housing 202 via one or more fill openings in one of the end plates 226, 228 that are sealed with plugs (now shown). The plugs may be fabricated from steel, plastic or other materials in various embodiments. In other embodiments a fill hole or fill holes may be provided in other locations, including but not limited to the housing 202 to facilitate the introduction of the filler material 232.

In one contemplated embodiment, the filling medium 232 is composed of quartz silica sand and a sodium silicate binder. The quartz sand has a relatively high heat conduction and absorption capacity in its loose compacted state, but can be silicated to provide improved performance. For example, by adding a liquid sodium silicate solution to the sand and then drying off the free water, silicate filler material 232 may be obtained with the following advantages.

The silicate material 232 creates a thermal conduction bond of sodium silicate to the fuse elements 218 and 220, the quartz sand, the fuse housing 202, the end plates 226 and 228, and the terminal contact blocks 222, 224. This thermal bond allows for higher heat conduction from the fuse elements 218, 220 to their surroundings, circuit interfaces and conductors. The application of sodium silicate to the quartz sand aids with the conduction of heat energy out and away from the fuse elements 218, 220.

The sodium silicate mechanically binds the sand to the fuse element, terminal and housing tube increasing the thermal conduction between these materials. Conventionally, a filler material which may include sand only makes point contact with the conductive portions of the fuse elements in a fuse, whereas the silicated sand of the filler material 232 is mechanically bonded to the fuse elements. Much more efficient and effective thermal conduction is therefore made possible by the silicated filler material 232, which in part facilitates the substantial size reduction of the fuse 200 relative to known fuses offering comparable performance.

FIG. 4 illustrates the fuse element assembly 208 in further detail. The power fuse 200 can operate at higher system voltages due to the fuse element design features in the assembly 208, that further facilitates reduction in size of the fuse 200.

As shown in FIG. 4, each of the fuse elements 218, 220 is generally formed from a strip of electrically conductive material into a series of co-planar sections 240 connected by oblique sections 242, 244. The fuse elements 218, 220 are generally formed in substantially identical shapes and geometries, but inverted relative to one another in the assembly 208. That is, the fuse elements 218, 220 in the embodiment shown are arranged in a mirror image relation to one another. Alternatively stated, one of the fuse elements 218, 220 is oriented right-side up while the other is oriented up-side down, resulting in a rather compact and space saving construction. While a particular fuse element geometry and arrangement is shown, other types of fuse elements, fuse element geometries, and arrangements of fuse elements are possible in other embodiments. The fuse elements 218, 220 need not be identically formed to one another in all embodiments. Further, in some embodiments a single fuse element may be utilized.

In the exemplary fuse elements 218, 220 shown, the oblique sections 242, 244 are formed or bent out of plane from the planar sections 240, and the oblique sections 242 have an equal and opposite slope to the oblique sections 244. That is, one of the oblique sections 242 has a positive slope and the other of the oblique sections 244 has a negative slope in the example shown. The oblique sections 242, 244 are arranged in pairs between the planar sections 240 as shown. Terminal tabs 246 are shown on either opposed end of the fuse elements 218, 220 so that electrical connection to the end plates 226, 228 may be established as described above.

In the example shown, the planar sections 240 define a plurality of sections of reduced cross-sectional area 241, referred to in the art as weak spots. The weak spots 241 are defined by round apertures in the planar sections 240 in the example shown. The weak spots 241 correspond to the thinnest portion of the section 240 between adjacent apertures. The reduced cross-sectional areas at the weak spots 241 will experience heat concentration as current flows through the fuse elements 218, 220, and the cross-sectional area of the weak spots 241 is strategically selected to cause the fuse elements 218 and 220 to open at the location of the weak spots 241 if specified electrical current conditions are experienced.

The plurality of the sections 240 and the plurality of weak spots 241 provided in each section 240 facilitates arc division as the fuse elements 218, 220 operate. In the illustrated example, the fuse elements 218, 220 will simultaneously open at three locations corresponding to the sections 240 instead of one. Following the example illustrated, in a 450 VDC system, when the fuse elements operate to open the circuit through the fuse 200, an electrical arc will divide over the three locations of the sections 240 and the arc at each location will have the arc potential of 150 VDC instead of 450 VDC. The plurality of (e.g., four) weak spots 241 provided in each section 240 further effectively divides electrical arcing at the weak spots 241. The arc division allows a reduced amount of filler material 232, as well as a reduction in the radius of the housing 202 so that the size of the fuse 200 can be reduced.

The bent oblique sections 242, 244 between the planar sections 240 still provide a flat length for arcs to burn, but the bend angles should be carefully chosen to avoid a possibility that the arcs may combine at the corners where the sections 242, 244 intersect. The bent oblique sections 242, 244 also provide an effectively shorter length of the fuse element assembly 208 measured between the distal end of the terminal tabs 246 and in a direction parallel to the planar sections 240. The shorter effective length facilitates a reduction of the axial length of the housing of the fuse 200 that would otherwise be required if the fuse element did not include the bent sections 242, 244. The bent oblique sections 242, 244 also provide stress relief from manufacturing fatigue and thermal expansion fatigue from current cycling operation in use.

To maintain such a small fuse package with high power handling and high voltage operation aspects, special element treatments may also be applied beyond the use of silicated quartz sand in the filler 232 and the formed fuse element geometries described above. In particular the application of arc blocking or arc barrier materials such as RTV silicones or UV curing silicones may be applied adjacent the terminal tabs 246 of the fuse elements 218, 220. Silicones yielding the highest percentage of silicon dioxide (silica) have been found to perform the best in blocking or mitigating arc burn back near the terminal tabs 246. Any arcing at the terminal tabs 246 is undesirable, and accordingly the arc blocking or barrier material 250 completely surrounds the entire cross section of the fuse elements 218, 220 at the locations provided so that arcing is prevented from reaching the terminal tabs 246.

A full range time-current operation is achieved by employing two fuse element melting mechanisms in each respective fuse element 218, 220. One melting mechanism in the fuse element 218 is responsive to high current operation (or short circuit faults) and one melting mechanism in the fuse element 220 is responsive to low current operation (or overload faults). As such, the fuse element 218 is sometimes referred to as a short circuit fuse element and the fuse element 220 is sometimes referred to as an overload fuse element.

In a contemplated embodiment, the overload fuse element 220 may include a Metcalf effect (M-effect) coating (not shown) where pure tin (Sn) is applied to the fuse element, fabricated from copper (Cu) in this example, in locations proximate the weak spots of one of the sections 240. During overload heating the Sn and Cu diffuse together in an attempt to form a eutectic material. The result is a lower melting temperature somewhere between that of Cu and Sn or about 400° C. in contemplated embodiments. The overload fuse element 220 and the section(s) 240 including the M-effect coating will therefore respond to current conditions that will not affect the short circuit fuse element 218. While in a contemplated embodiment the M-effect coating may be applied to about one half of only one of the three sections 240 in the overload fuse element 220, the M-effect coating could be applied at additional ones of the sections 240 if desired. Further, the M-effect coating could be applied as spots only at the locations of the weak spots in another embodiment as opposed to a larger coating applied to the applicable sections 240 away from the weak spots.

Lower short circuit let through energy is accomplished by reducing the fuse element melting cross section in the short circuit fuse element 218. This will normally have a negative effect on the fuse rating by lowering the rated ampacity due the added resistance and heat. Because the silicated sand filler material 232 more effectively removes heat from the fuse element 218, it compensates for the loss of ampacity that would otherwise result.

The application of sodium silicate to the quartz sand also aids with the conduction of heat energy out and away from the fuse element weak spots and reduces mechanical stress and strain to mitigate load current cycling fatigue that may otherwise result. In other words, the silicated filler 232 mitigates fuse fatigue by reducing an operating temperature of the fuse elements at their weak spots. The sodium silicate mechanically binds the sand to the fuse element, terminal and housing increasing the thermal conduction between these materials. Less heat is generated in the weak spots and the onset of mechanical strain and fuse fatigue is accordingly retarded, but in an EV application in which the current profile shown in FIG. 1 is applied across the fuse failure of the fuse elements due to fatigue, as opposed to short circuit or overload conditions, has become a practical limitation to the lifespan of the fuse.

The fuse elements described, like conventionally designed fuses utilize metal stamped or punched fuse elements, have been found to be disadvantaged for EV applications including the type of cyclic current loads described above. Such stamped fuse element designs whether fabricated from copper or silver or copper alloys undesirably introduce mechanical strains and stresses on the fuse element weak spots 241 such that a shorter service life tends to result. This short fuse service life manifests itself in the form of nuisance fuse operation resulting from the mechanical fatigue of the fuse element at the weak spots 241.

Figure 6:
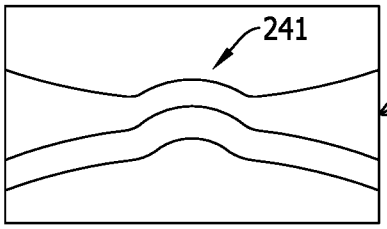
FIG. 6 is a magnified view of a portion of the fuse element shown in FIG. 5 in a fatigued state.
Figure 5:
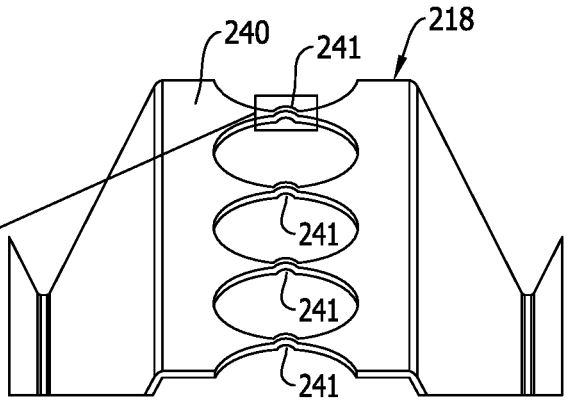
FIG. 5 shows a portion of the fuse element assembly shown in FIG. 4.

As shown in FIGS. 5 and 6, repeated high current pulses lead to metal fatigue from grain boundary disruptions followed by crack propagation and failure in the fuse elements 218, 220. The mechanical constraints of the fuse element 218, 220 are inherent in the stamped fuse element design and manufacture, which unfortunately has been found to promote in-plane buckling of the weak spots 241 during repeated load current cycling. This in-plane bucking is the result of damage to the metal grain boundaries where a separation or slippage occurs between adjacent metal grains. Such buckling of weak spots 241 occurs over time and is accelerated and more pronounced with higher transient current pulses. The greater the heating-cooling delta in the transient current pulses the greater the mechanical influence and thus the greater the in-place buckling deformation of the weak spots 241.

Repeated physical mechanical manipulations of metal, caused by the heating effects of the transient current pulses, in turn cause changes in the grain structure of metal fuse element. These mechanical manipulations are sometimes referred to as working the metal. Working of metals will cause a strengthening of the grain boundaries where adjacent grains are tightly constrained to neighboring grains. Over working of a metal will result in disruptions in the grain boundary where grains slip past each other and cause what is called a slip band or plane. This slippage and separation between the grains result in a localized increase of the electrical resistance that accelerates the fatigue process by increasing the heating effect of the current pulses. The formation of slip bands is where fatigue cracks are first initiated.

The inventors have found that a manufacturing method of stamping or punching metal to form the fuse elements 218, 220 causes localized slip bands on all stamped edges of the fuse element weak spots 241 because the stamping processes to form the weak spots 241 is a shearing and tearing mechanical process. This tearing process pre-stresses the weak spots 241 with many slip band regions. The slip bands and fatigue cracks, combined with the buckling described due to heat effects, eventually lead to a premature structural failure of the weak spots 241 that are unrelated to electrical fault conditions. Such premature failure mode that does not relate to a problematic electrical condition in the power system is sometimes referred to as nuisance operation of the fuse. Since once the fuse elements fail the circuitry connected to the fuse is not operational again until the fuse is replaced, avoiding such nuisance operation is highly desirable in an EV power system from the perspective of both EV manufacturers and consumers. Indeed, given an increased interest in EV vehicles and the power systems therefore, the effects of fuse fatigue are deemed to be a negative Critical to Quality (CTQ) attribute in the vehicle design.

Accordingly, a new design method for fabricating fuse elements including weak spots that are fatigue resistant is highly desirable. A possible approach would be to eliminate stamping stress by use of laser or waterjet cutting methods to fabricate a fuse element geometry including weak spots from a piece of metal. Both laser and waterjet cutting methods may be combined, wherein laser power for cutting is employed and the waterjet is employed for cooling and debris removal in fabricating a fuse element including a desired number of weak spots. Such methods are advantageous in part by eliminating the pre-stressing of the weak spots 241 with slip bands as described above. Such fabrication methods will not, however, eliminate fatigue from working of the metal and buckling at the weak spots 241. Such methods may therefore offer extended service life relative to stamped metal fuse elements, but nuisance fuse operation will still result and other solutions are desired.

FIGS. 7-11 illustrate respective fabrication stages of a fatigue resistant fuse element assembly 300 including wire bonded weak spots rather than conventional metal stamped weak spots. The wire bonded weak spots eliminate pre-stressing of the weak spots and the buckling issues described above that are common to metal stamped fuse elements, and accordingly avoid nuisance operation described above in the same operating conditions presenting cyclic current loads such as those shown in FIG. 1.

Figure 7:
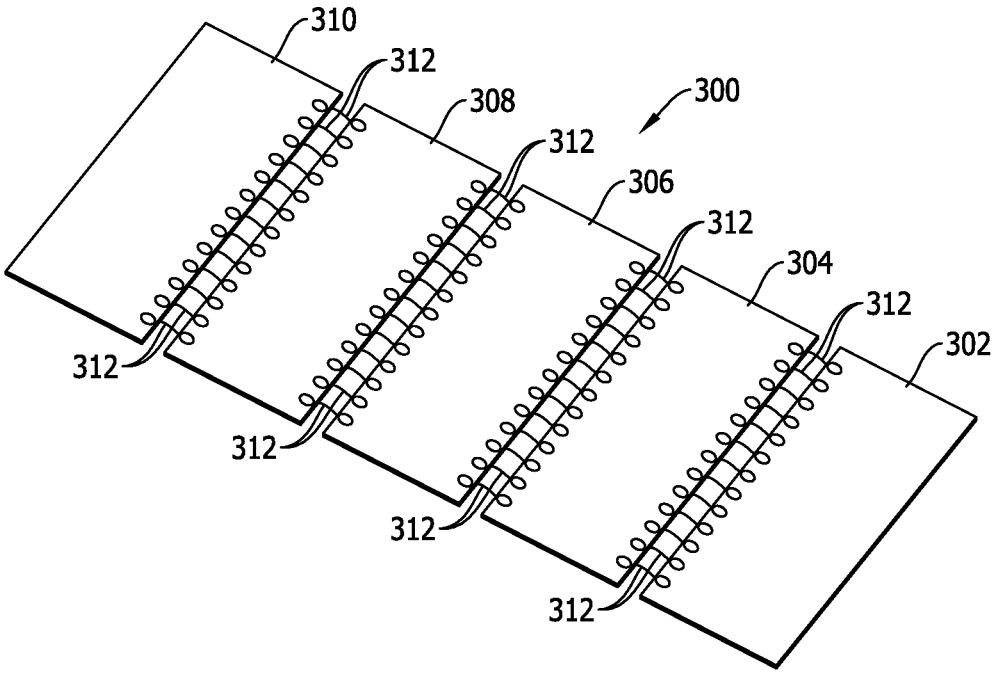
FIG. 7 is a top perspective view of a fatigue resistant fuse element assembly in a first stage of manufacture.

FIG. 7 shows a fatigue resistant fuse element assembly 300 according to an exemplary embodiment of the present invention. The fuse element assembly 300 includes a series of conductive plates 302, 304, 306, 308 and 310, and separately provided conductive wire bonded weak spot elements 312 interconnecting the plates 302, 304, 306, 308 and 310. The plates 302, 304, 306, 308 and 310 may be fabricated from a conductive metal or alloy such as those described above. The plates 302, 304, 306, 308 and 310 are generally aligned in a co-planar relationship with one another, and are slightly spaced apart from one another, with the conductive wire bonded weak spot elements 312 extending across the space between adjacent ones of the plates 302, 304, 306, 308 and 310.

Figure 9:
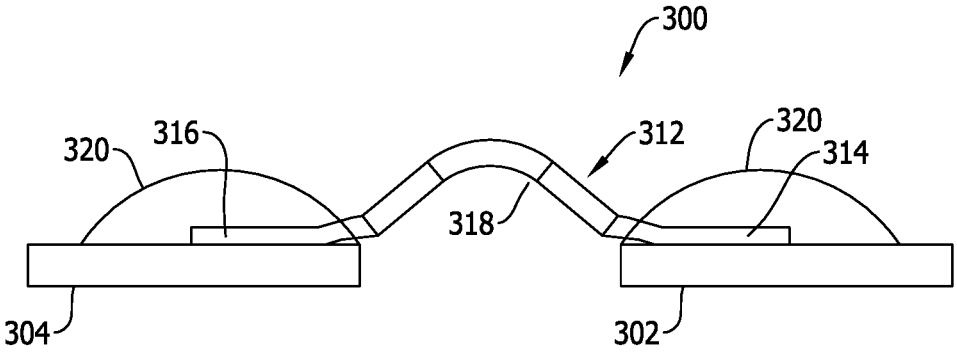
FIG. 9 is a partial cross sectional view of the fuse element assembly shown in FIG. 8.

The wire bonded weak spot elements 312 includes wires that are separately provided from but mechanically and electrically connected to the respective plates 302, 304, 306, 308 and 310 via, for example, soldering, brazing, welding or other techniques known in the art. As seen in FIG. 9, each wire bonded weak spot element 312 may include a first end 314 connected to a first one of the plates, a second end 316 connected to a second one of the plates and a strain relief loop portion 318 extending between the first and second ends 314, 316. The first and second ends 314, 316 extend in a generally planar manner on each respective plate, while the strain relief loop portion 318 extends in an arch-like shape between the ends 314, 316. The inclusion of the strain relief loop portion 318 between bond locations to the respective plates reduces the buckling fatigue from thermal mechanical cycles.

The wires of the wire bonded weak spot elements 312 may be provided in an elongated round or cylindrical shape or form having a constant or uniform cross-sectional area of any desired area to define any desired number of weak spots of reduced cross-sectional area between the plates 302, 304, 306, 308 and 310 and promote fusible operation between the plates 302, 304, 306, 308 and 310. The wires of the wire bonded weak spot elements 312 may also be provided in a flat shape having a rectangular cross-sectional area or form, sometimes referred to as a wire ribbon material. Regardless, the use of wire bonded weak spot elements 312 eliminates stress from metal stamping processes. The wire bonded weak spot elements 312 including the strain relief portions 318 are separately fabricated from the plates 302, 304, 306, 308 and 310 to eliminate any a need for a complex fuse element forming geometry that otherwise is required from a single piece fuse element construction such as the fuse elements 218, 220 described above.

In some embodiments, the wire bonded weak spot elements 312 and the plates 302, 304, 306, 308 and 310 may be fabricated from different materials and dimensions such that the electrical resistance of the wire and the plates 302, 304, 306, 308 and 310 are independent. In contemplated embodiments, aluminum wire for the wire bonded weak spot elements 312 in combination with copper plates 302, 304, 306, 308 and 310 is believed to be advantageous. Aluminum has a melting point of about 660° C. which is 302° C. less than silver and 425° C. less than copper. The lower melting temperature of aluminum equates to lower short circuit let through energy (time and peak current or $I^2t$) in the wire bonded weak spot elements 312. Further, Aluminum resistivity is 28.2 nΩ·m (about 1.8 times the resistivity of silver as seen in the comparative table below for enhanced fuse performance when aluminum is utilized for the wire bonded weak spot elements 312, while the copper plates 302, 304, 306, 308 and 310 keeps the element resistance low.

| Material | Resistivity (nΩ · m) | Melt Temp (° C.) | Thermal Cond ($W \cdot m^{-1} \cdot K^{-1}$) | Density ($g \cdot cm^{-3}$) |
|---|---|---|---|---|
| Silver | 15.87 | 961.78 | 429 | 10.49 |
| Copper | 16.78 | 1084.62 | 401 | 8.94 |
| Gold | 22.14 | 1064.18 | 318 | 19.30 |
| Aluminum | 28.20 | 660.32 | 237 | 2.70 |

In another contemplated embodiment, silver wires in the wire bonded weak spot elements 312 and copper plates 302, 304, 306, 308 and 310 provides a cost effective alternative to all silver stamped fuse elements that tend to be utilized in certain types of current limiting fuses. Further variations are, of course, possible.

Regardless of the materials utilized for the wire bonded weak spot elements 312 and copper plates 302, 304, 306, 308 and 310, there are three basic wire bonding techniques that may be employed in the fabrication of the assembly 300. Thermosonic bonding of the wires utilizes temperature, ultrasonic and low impact force for ball and wedge-type attachment methods. Ultrasonic bonding of the wires utilizes ultrasonic and low impact force, and the wedge method only. Thermocompression bonding of the wires utilizes temperature and high impact force, and the wedge method only.

In the exemplary embodiment shown, five conductive plates 302, 304, 306, 308 and 310 are shown in the assembly 300 that are interconnected by thirteen wire bonded weak spot elements 312 between adjacent plates. The assembly 300 is therefore well suited for a high voltage EV power system application with arc division across the thirteen wire bonded weak spot elements 312 between each plate at each of the four locations between the plates 302, 304, 306, 308 and 310, for a total of fifty two wire bonded weak spot elements 312 in the assembly 300. In other embodiments, however, varying numbers of plates 302, 304, 306, 308 and 310 and/or numbers of wire bonded weak spots 312 may alternatively be utilized between adjacent plates. While an exemplary geometry of the plates 302, 304, 306, 308 and 310 is shown, other geometries are possible. Also, each plate 302, 304, 306, 308 and 310 is generally planar in the example shown, whereas in another embodiment the plates 302, 304, 306, 308 and 310 may include sections bent out of plane in a similar manner to the fuse elements 218, 220 described above.

Figure 8:
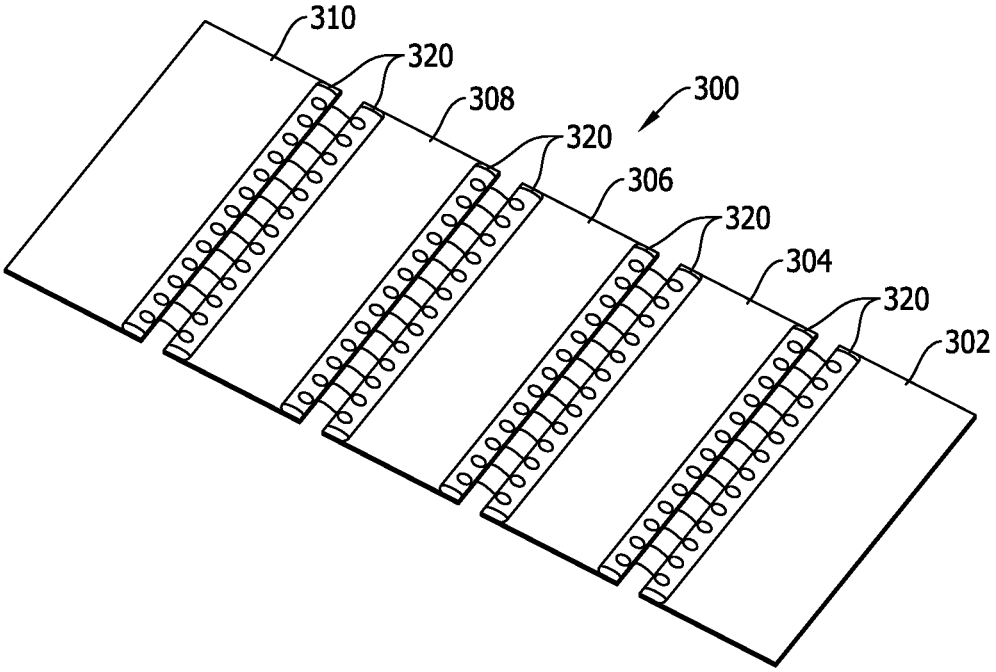
FIG. 8 is a top perspective view of the fatigue resistant fuse element assembly shown in FIG. 7 in a second stage of manufacture.

As shown in FIGS. 8 and 9, the fuse element assembly 300 also includes a sealing material 320 applied to the end edges of each plate and encapsulating the ends 314, 316 of the wire bonded weak spot elements 312. The sealing material 312 in contemplated embodiments may be Silicone such as those described above. The sealing material 320 provides a hermetic seal and an arc barrier property to the assembly 300. The hermetic sealing avoids corrosion and electrolysis issues that may otherwise occur for the wire bonded connections, as well as wards off oxidation of the joint metals, a particular benefit when aluminum wires are utilized as described above for the wire bonded weak spot elements 312. An arc quenching barrier is also provided by the sealing material 320 for both AC and DC arcs as the fuse operates.

In another contemplated embodiment, the sealing material 320 may alternatively be the solder that is used to connect ends 314, 316 of the wire bonded weak spot elements 312 to the respective the plates 302, 304, 306, 308 and 310. That is, in some instances the solder can effectively seal the ends 314, 316 of the wire bonded weak spot elements 312 in the assembly. If the solder is pure tin then it can also become a seal and an M-spot material when used with copper wire bonded weak spot elements 312. It is understood, however, that an M-effect material could be independently applied as desired in still other embodiments and need not be accomplished via the soldering material.

It is also contemplated that in some embodiments both solder and an arc barrier material such as Silicone may be applied in combination on the ends 314, 316 of the wire bonded weak spot elements 312 to collectively define the sealing material 320. That is, a Silicone layer may be applied over a solder layer, with the solder acting as a seal and the Silicone acting as an arc quenching material and barrier. Numerous other options are possible to provide varying degrees of sealing and arc barrier properties to meet different specifications for the fuse in an electrical power system.

Figure 10:
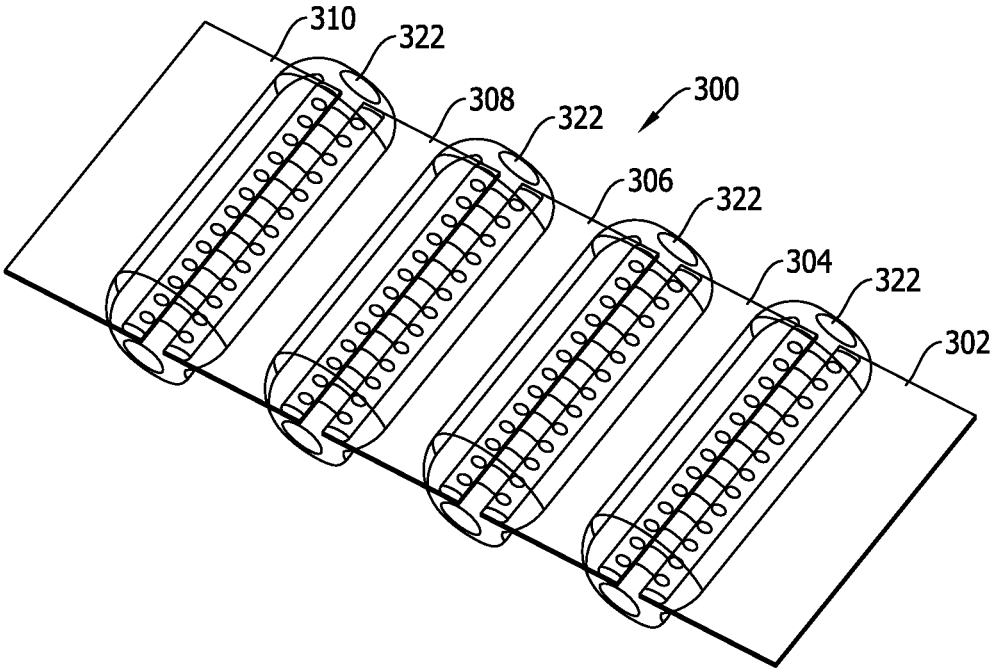
FIG. 10 is a top perspective view of the fatigue resistant fuse element assembly shown in FIG. 8 in a third stage of manufacture.
Figure 11:
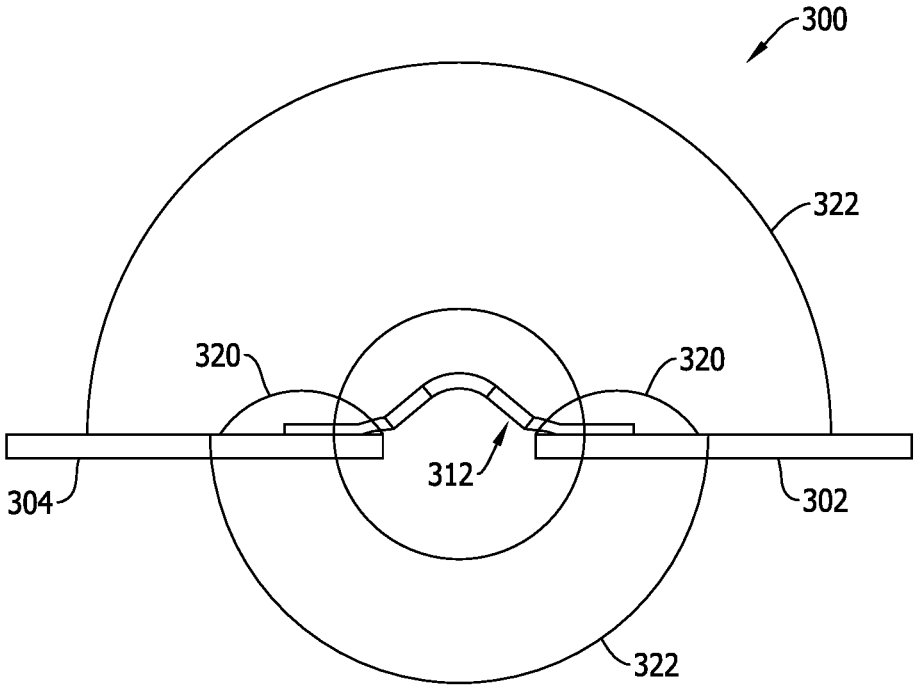
FIG. 11 is a partial cross sectional view of the fuse element assembly shown in FIG. 10.

As shown in FIGS. 10 and 11, an arc quenching media 322 such as stone sand is also provided over the sealing material 320 and the loop portions 318 of the wire bonded weak spot elements 312. Unlike the sealing material 320 that generally extends on only above the adjacent plates in the exemplary embodiments shown, the arc quenching media 322 extends above and below the plates. The arc quenching media 322 provides several functions including heat sinking, arc quenching, and mechanical support of the loop portions 318 of the wire bonded weak spot elements 312. Stone or silicated sand provides mechanical support for the loop portions 318 of the wire bonded weak spot elements, and the stone sand can be blended of quartz silica sand, sodium silicate and melamine powder for extra arc quenching capability.

The arc quenching media 322 may be applied to the fuse element assembly 300 as a compound or solution having a semisolid consistency such that when applied from above a portion of the arc quenching media 322 seeps through the opening between the plates and contacts the bottom side of the plates while completely surrounding the wire bonded weak spots 312. As shown in FIGS. 10 and 11, however, the arc quenching media 322 does not surround the entirety of the fuse element assembly. Instead, and as seen in FIG. 10, portions of the plates 302, 304, 306, 308 and 310 are not covered by the arc quenching media at all in between the wire bonded fuse elements 312. Such targeted use of the arc quenching media 312 not only saves costs but reduces the weight of the fuse including the fuse element assembly.

Silicated media may be bonded to the wire bonded weak spots 312 for improved thermal performance of the fuse element assembly as discussed above for the fuse elements 218, 220. The melamine powder included in the arc quenching media 312 generates an arc extinguishing gas for further performance improvements as the fuse opens in response to an electrical fault condition.

FIGS. 12-16 illustrate fabrication stages of a batch production process for fabricating the fuse element assemblies 300.

Figure 12:
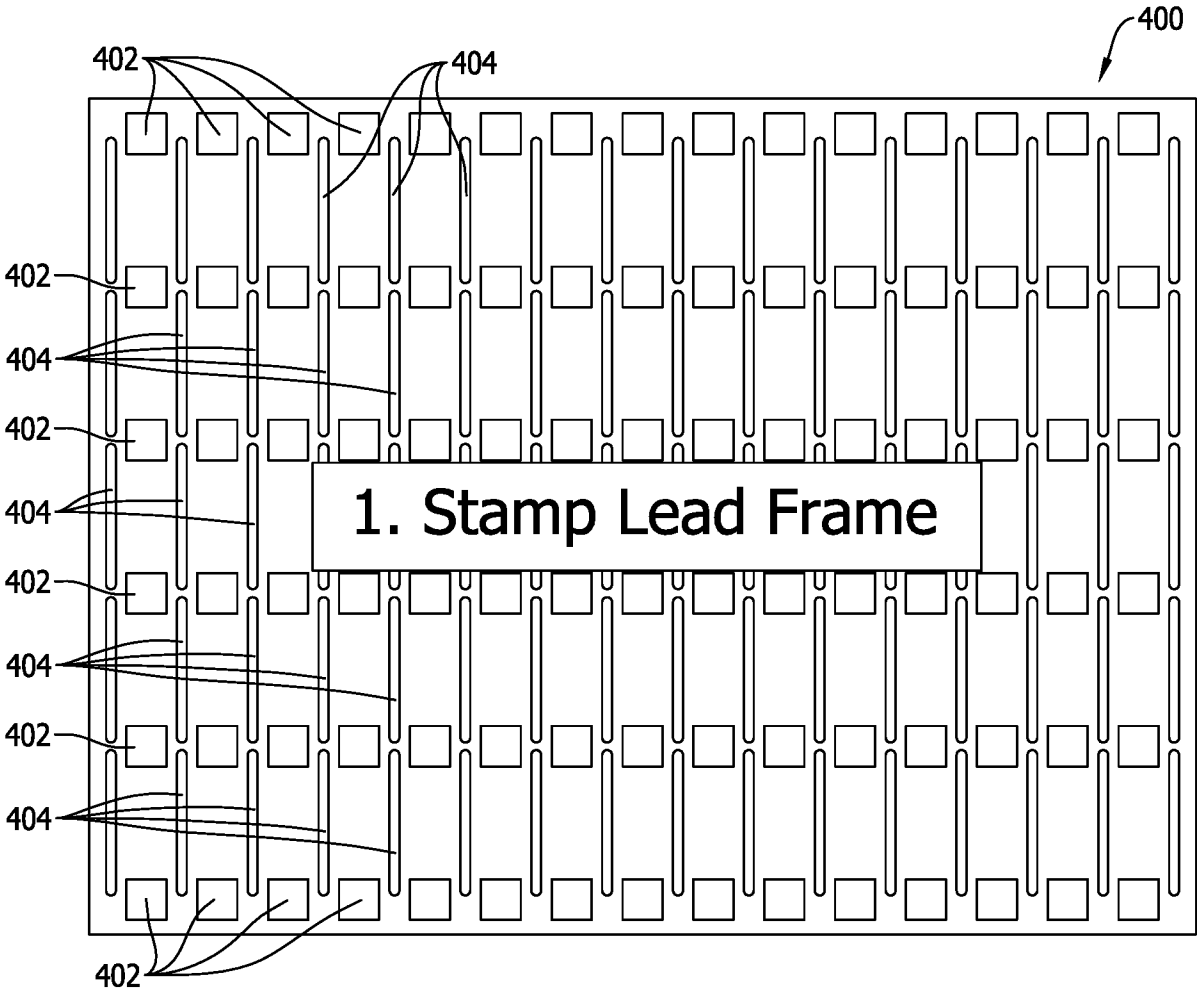
FIG. 12 is a top plan view of a batch process of making the fatigue resistant fuse element assembly at a first stage of production.

As shown in FIG. 12, a lead frame 400 of a conductive metal such as copper is constructed from a sheet of metal that is stamped with a number of rectangular openings 402 and elongated slots 404 as shown.

Figure 13:
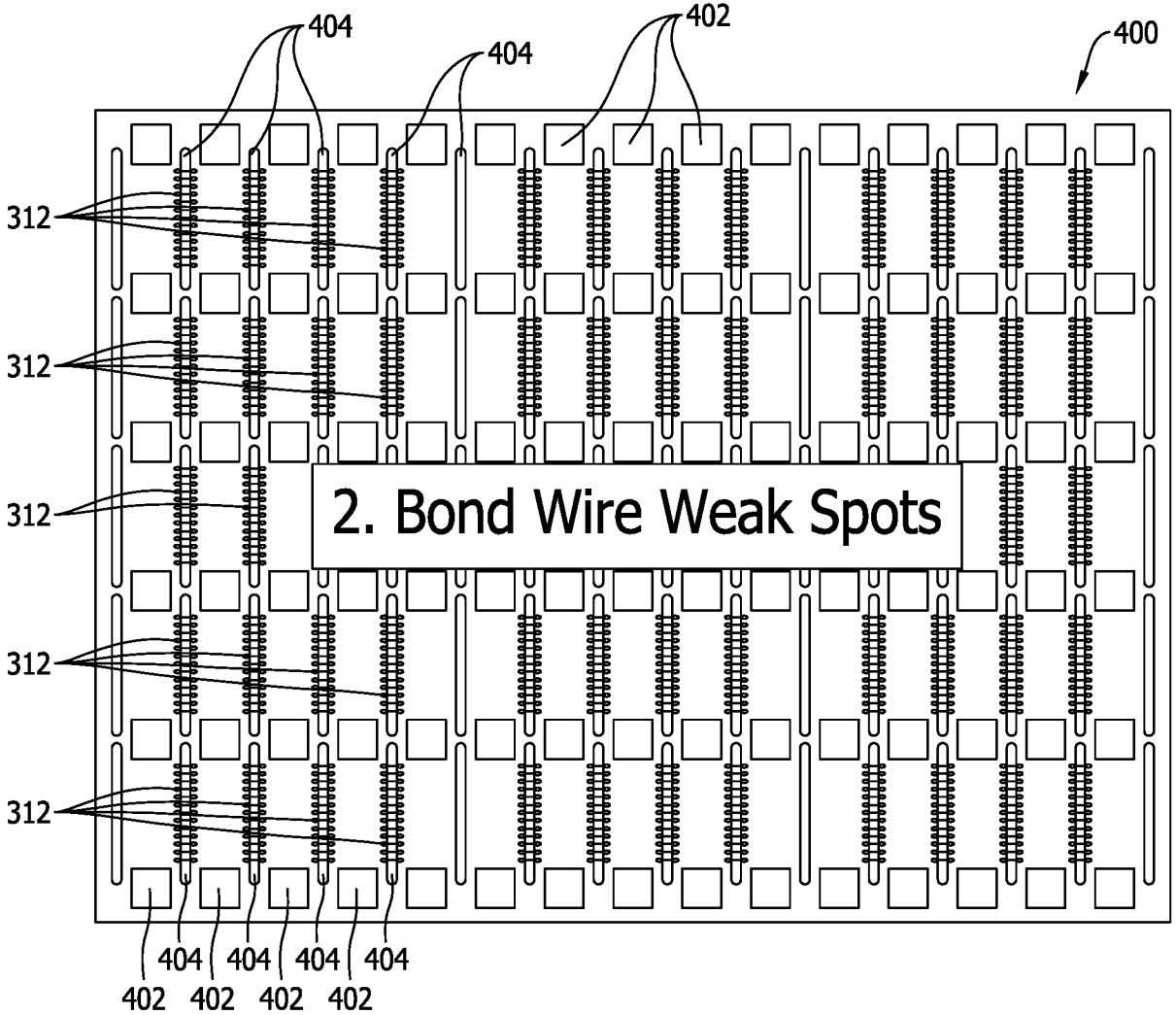
FIG. 13 is a top plan view of a batch process of making the fatigue resistant fuse element assembly at a second stage of production.

As shown in FIG. 13, columns of wire bonded weak spots 312 are connected across desired ones of the elongated slots 404 on the lead frame 400 as shown. Any of the techniques described above may be employed to connect the wire bonded weak spots 312

Figure 14:
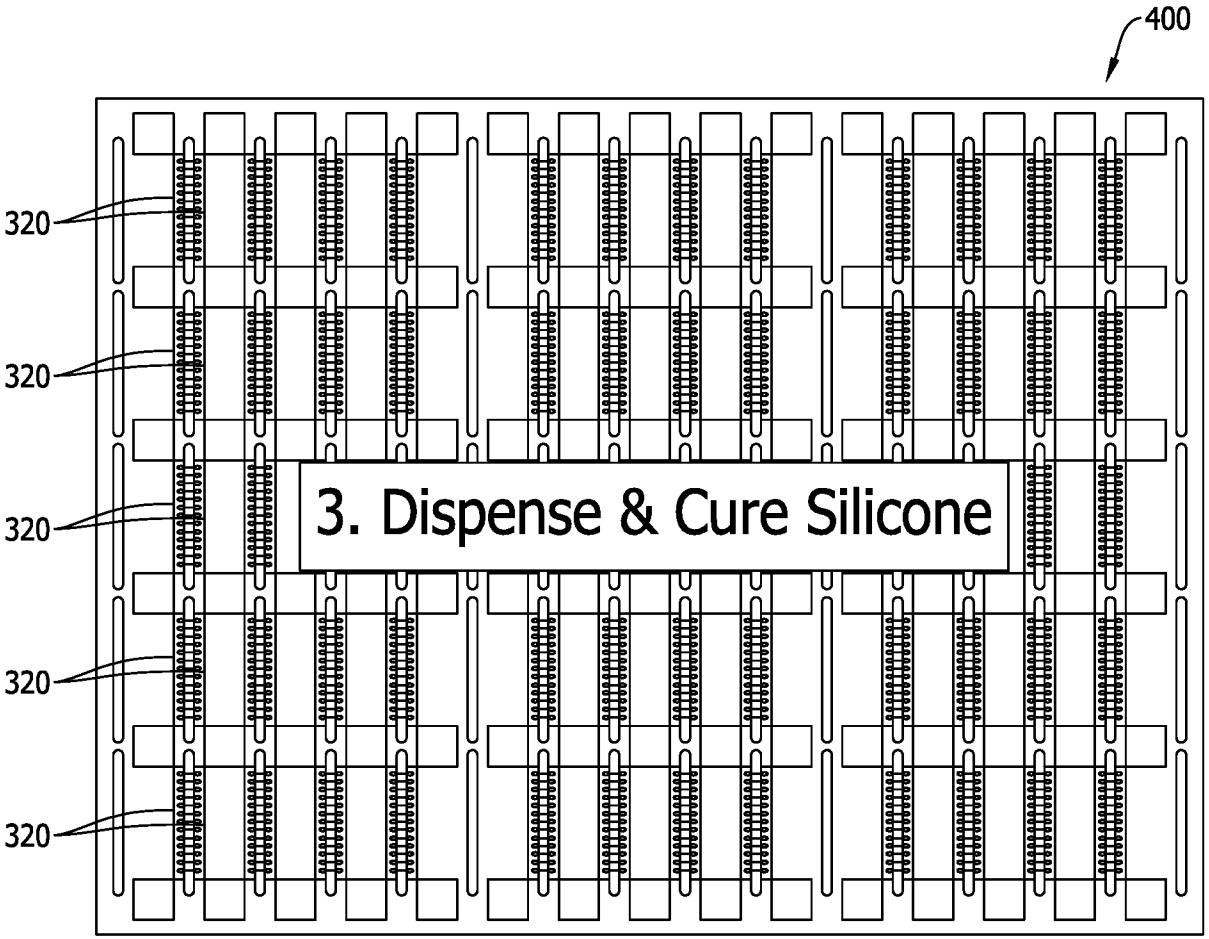
FIG. 14 is a top plan view of a batch process of making the fatigue resistant fuse element assembly at a third stage of production.

As shown in FIG. 14, columns of sealing material 320 are dispensed and applied cover the wire bonded weak spots 312 on the lead frame 400 as shown. The sealing material 320 of the wire bonded joints creates a hermetic seal to prevent or reduce oxidation and corrosion that may otherwise occur, as well as provides arc quenching barrier when fuse operates or opens.

Figure 15:
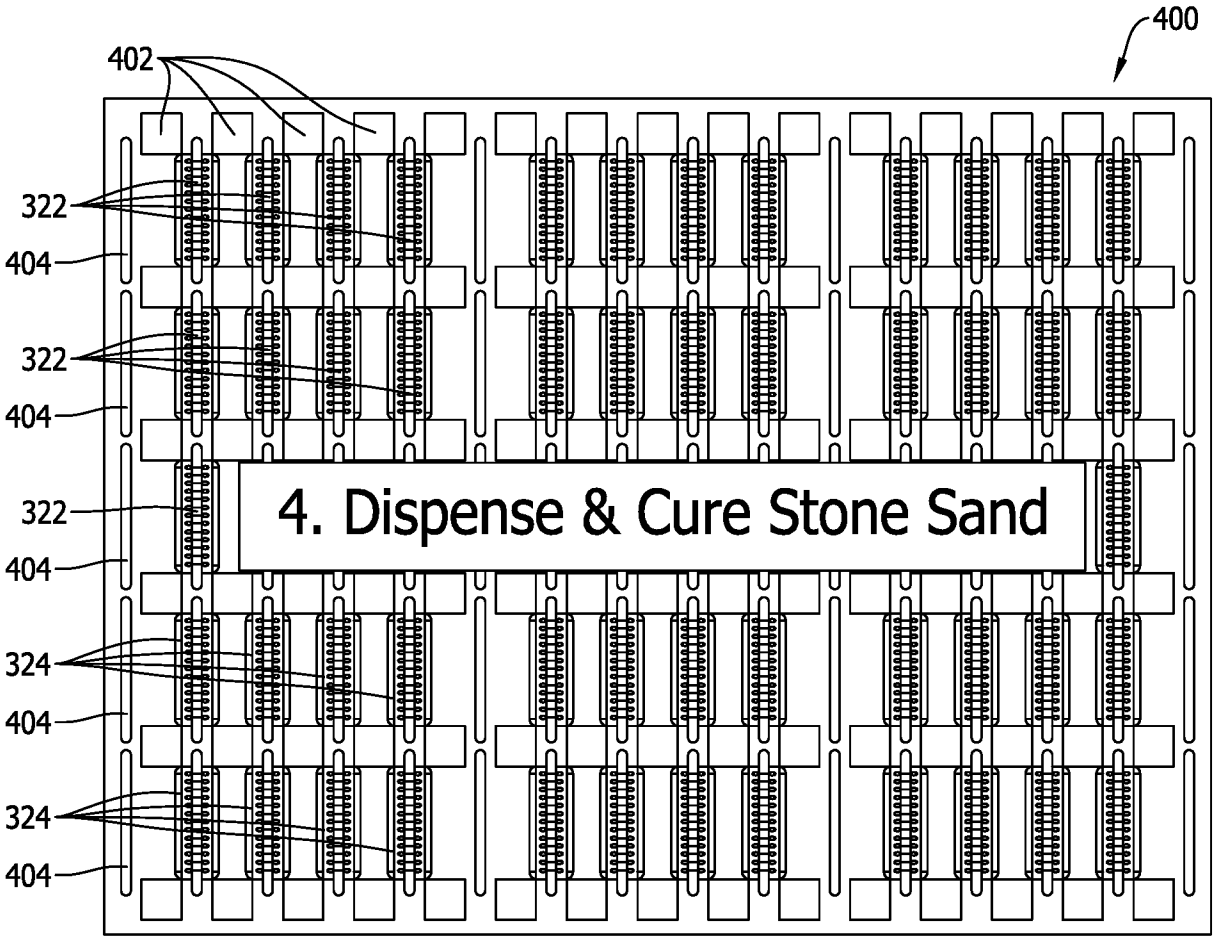
FIG. 15 is a top plan view of a batch process of making the fatigue resistant fuse element assembly at a fourth stage of production.

As shown in FIG. 15, columns of arc quenching media 322 are dispensed and applied over the sealing material 320 on the lead frame 400 as shown.

Figure 16:
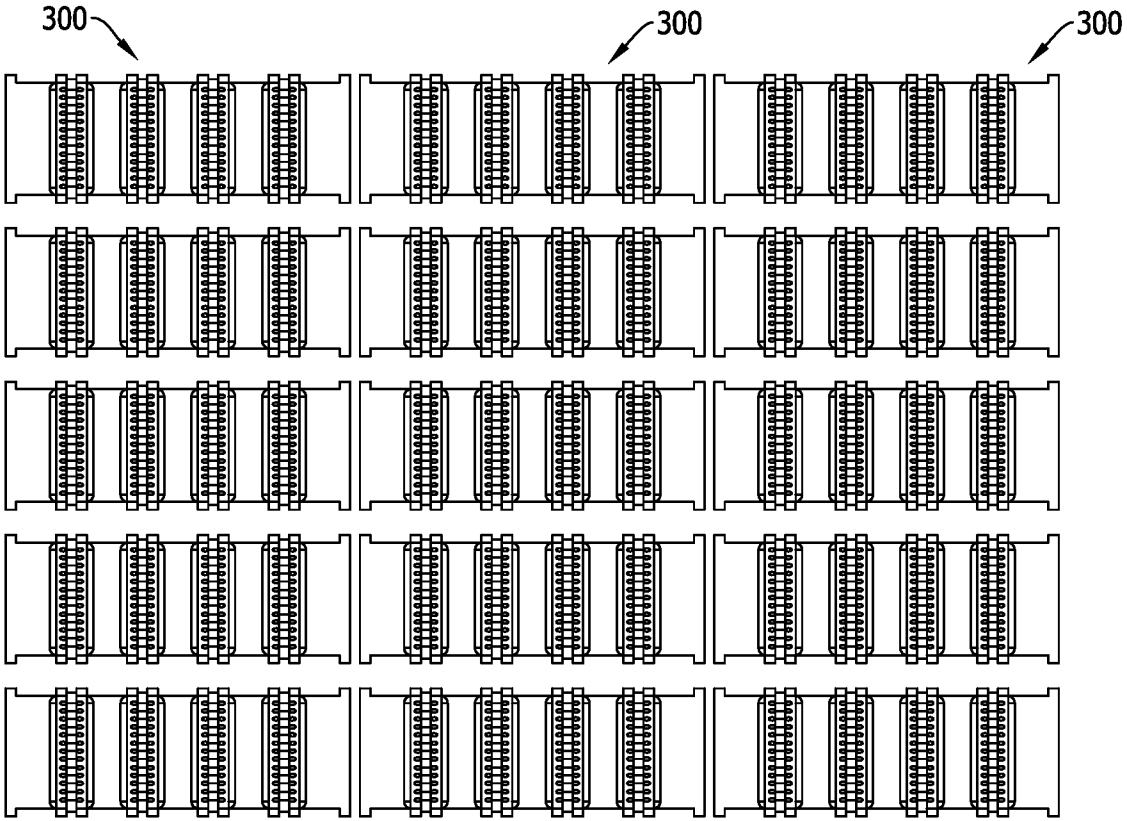
FIG. 16 is a top plan view of a batch process of making the fatigue resistant fuse element assembly at a fifth stage of production.

As shown in FIG. 16, the lead frame 400 is stamped to singulate the fuse element assemblies 300 by removing the metal material between the apertures 402 (FIGS. 12-15). In the example shown, fifteen fuse element assemblies 300 are formed in the batch process performed on the lead frame 400.

Figures 17, 18:
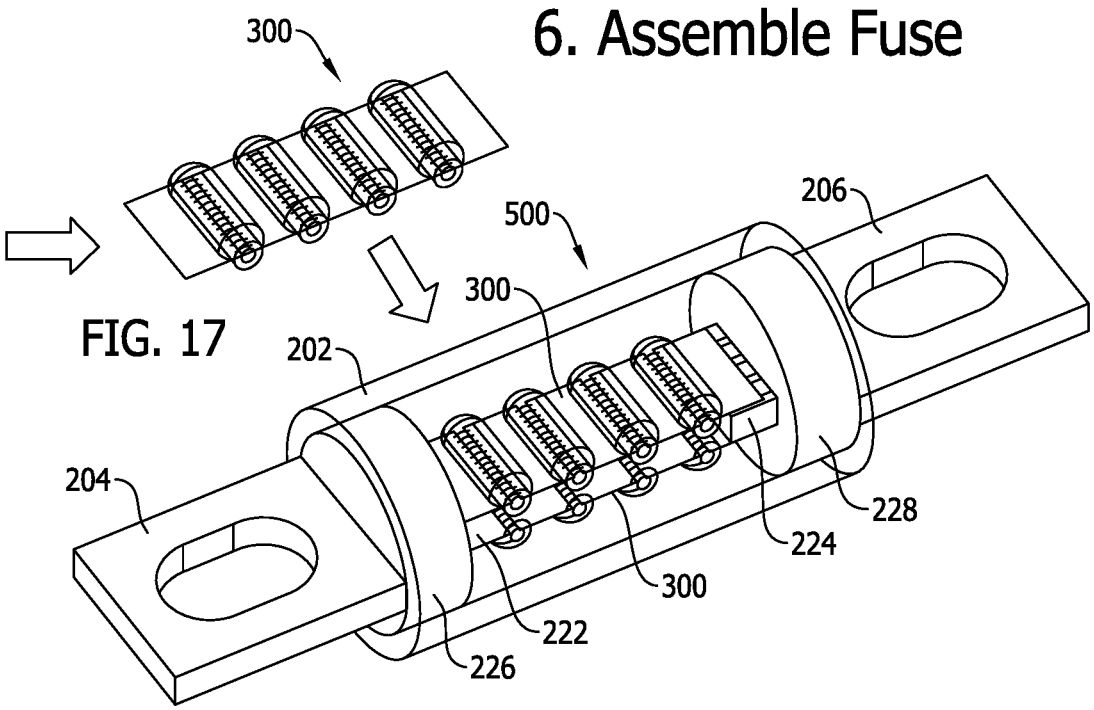
FIG. 17 is a top plan view of the completed fatigue resistant fuse element assembly produced by the processes illustrated in FIGS. 12-16.
FIG. 18 is a perspective view of a power fuse including fuse element assemblies as shown in FIG. 17.

FIG. 17 shows the completed fuse element assembly 300 ready for the fabrication of a fuse. FIG. 18 shows a fuse 500 including two fuse elements assemblies 300 inside the housing 202 and the elements 204, 206, 224, 226 and 228 described above. The fuse 500, like the fuse 300, may be engineered to provide a 500V, 150 A rated fuse suitable for EV power systems and withstanding the drive profile of FIG. 1 without nuisance operation due to fatigue like the fuse 200 described above. The fuse 500 may also be fabricated with similar dimensions to the fuse 200 described, providing a high voltage power fuse with a 50% reduction in size for EV power system applications.

The benefits and advantages of the present invention are now believed to have been amply illustrated in relation to the exemplary embodiments disclosed.

An embodiment of a power fuse has been disclosed including a housing, first and second conductive terminals extending from the housing, and at least one fatigue resistant fuse element assembly connected between the first and second terminals. The fuse element assembly includes at least a first conductive plate and a second conductive plate respectively connecting the first and second conductive terminals, and a plurality of separately provided wire bonded weak spots interconnecting the first conductive plate and the second conductive plate.

Optionally, the first conductive plate and the second conductive plate may be fabricated from a first conductive material, and the wire bonded weak spots may be fabricated from a second conductive material different from the first conductive material. The first conductive material may be copper, and the second conductive material may be aluminum. Alternatively, the second conductive material may be silver.

The power fuse may also optionally include a sealing element covering respective ends of the wire bonded weak spots that are connected to the respective first conductive plate and the second conductive plate. The sealing element may be at least one of solder, an M-spot material or an arc barrier material. An arc quenching media may also cover the sealing element. The arc quenching media may be silicate sand or stone, and may also include melamine powder. Portions of the first conductive plate and the second conductive plate may not be covered by the arc quenching media.

The at least one fatigue resistant fuse element assembly may include two fatigue resistant fuse element assemblies each having at least a first conductive plate and a second conductive plate and a plurality of wire bonded weak spots interconnecting the first conductive plate and the second conductive plate. The fuse may have a voltage rating of at least 500V. The fuse may have a current rating of at least 150 A. The first and second conductive terminals include first and second terminal blades. The housing may be cylindrical.

The at least a first conductive plate and a second conductive plate may include five conductive plates with the plurality of wire bonded weak spots extending between respective ones of the five conductive plates. Each of the plurality of wire bonded weak spots may include a strain relief loop portion. The plurality of wire bonded weak spots may include thirteen wire bonded weak spots. The plurality of wire bonded weak spots each include a round wire. The first conductive plate and the second conductive plate may be arranged in a coplanar relationship, and the plurality of wire bonded weak spots may extend out of the plane of the first conductive plate and a second conductive plate.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A compact power fuse comprising:

a housing;

first and second conductive terminals extending from the housing; and a fuse element assembly contained in the housing and being connected between the first and second terminals, the fuse element assembly fabricated to address otherwise expected nuisance operation caused by mechanical fatigue attributable to thermal cyclic stress associated with seemingly random current load cycling that does not present a short circuit or overload condition in an operating power system of an electric vehicle by virtue of at least one prefabricated fatigue resistant assembly including:

at least a first conductive plate and a second conductive plate arranged in a coplanar relationship to one another;

a plurality of wire bonded weak spots interconnecting the first conductive plate and the second conductive plate, each of the plurality of wire bonded weak spots being separately provided from one another and having a first end connected to the first conductive plate and a second connected to the second conductive plate;

a sealing element comprising an arc barrier material and covering only respective ends of the plurality of wire bonded weak spots that are connected to the respective first conductive plate and the second conductive plate, the sealing element not covering a majority of the plurality of wire bonded weak spots; and an arc quenching media covering the sealing element;

wherein the power fuse is engineered to provide a current rating of at least 150 A.

2. The power fuse of claim 1, wherein the first conductive plate and the second conductive plate are each fabricated from a first conductive material, and wherein the plurality of wire bonded weak spots are fabricated from a second conductive material different from the first conductive material.

3. The power fuse of claim 2, wherein the first conductive material is copper.

4. The power fuse of claim 3, wherein the second conductive material is aluminum.

5. The power fuse of claim 2, wherein the second conductive material is silver.

6. The power fuse of claim 1, wherein the sealing element further comprises solder or an M-spot material.

7. The power fuse of claim 1, wherein the arc quenching media mechanically supports the wire bonded weak spots.

8. The power fuse of claim 7, wherein the arc quenching media includes silicate sand or stone.

9. The power fuse of claim 7, wherein the arc quenching media includes melamine powder.

10. The power fuse of claim 7, wherein the arc quenching media further covers a portion of the first conductive plate and the second conductive plate that is opposite from the sealing element and the plurality of wire bonded weak spots such that the arc quenching media extends above and below a part of the first conductive plate and the second conductive plate, the plurality of wire bonded weak spots form one or more rows, and the arc quenching media does not cover portions of the first conductive plate and the second conductive plate that are between the one or more rows of wire bonded weak spots.

11. The power fuse of claim 1, wherein the at least one prefabricated fatigue resistant assembly includes first and second prefabricated fatigue resistant assemblies each being directly connected to and between the first conductive terminal and to the second conductive terminal and therefore are electrically connected in parallel to one another inside the housing.

12. The power fuse of claim 1, wherein the power fuse is engineered to provide a voltage rating of at least 500V.

13. The power fuse of claim 1, wherein the first and second conductive terminals comprise first and second terminal blades.

14. The power fuse of claim 1, wherein the housing is cylindrical.

15. The power fuse of claim 1, wherein the at least a first conductive plate and a second conductive plate in the prefabricated fatigue resistant assembly comprises five conductive plates with respective pluralities of wire bonded weak spots extending between adjacent ones of the five conductive plates.

16. The power fuse of claim 1, wherein each of the plurality of wire bonded weak spots includes a strain relief loop portion.

17. The power fuse of claim 1, wherein the plurality of wire bonded weak spots includes thirteen wire bonded weak spots interconnecting the first conductive plate and the second conductive plate.

18. The power fuse of claim 1, wherein the plurality of wire bonded weak spots comprises a plurality of round wires.

19. The power fuse of claim 1, wherein the plurality of wire bonded weak spots extend partially in the plane of the first and second conductive plate and extend partially out of the plane of the first conductive plate and a second conductive plate.

20. The power fuse of claim 1, wherein the arc barrier material of the sealing element comprises silicone.

21. A prefabricated fatigue resistant fuse assembly for power fuse comprising:

a plurality of conductive plates arranged in a coplanar relationship to one another;

a plurality of wire bonded weak spots interconnecting respective ones of the plurality of conductive plates, each of the plurality of wire bonded weak spots being separately provided from one another and having a first end connected to the first conductive plate and a second end connected to the second conductive plate;

a sealing element comprising an arc barrier material and covering only respective ends of the plurality of wire bonded weak spots on a portion of the respective ones of the plurality of conductive plates, the sealing element not covering a majority of the plurality of wire bonded weak spots; and an arc quenching media covering the sealing element and mechanically supporting the wire bonded weak spots, wherein the fuse assembly having an improved fatigue resistance at a current rating of at least 150 A and is fabricated to address otherwise expected nuisance operation caused by mechanical fatigue attributable to seemingly random thermal cyclic loading associated with load current cycling that does not present a short circuit or overload condition in an operating power system of an electric vehicle.

22. The prefabricated fatigue resistant fuse assembly of claim 21, wherein the arc quenching media further covers a portion of the plurality of conductive plates that is opposite from the sealing element and the plurality of wire bonded weak spots such that the arc quenching media extends above and below a part of the plurality of conductive plates, the plurality of wire bonded weak spots form one or more rows, and the arc quenching media does not cover portions of the plurality of conductive plates that are between the one or more rows of wire bonded weak spots.

23. The prefabricated fatigue resistant fuse assembly of claim 21, in combination with a housing and terminals projecting from a housing to complete the fabrication of the power fuse.

24. The prefabricated fatigue resistant fuse assembly of claim 23, wherein the power fuse is engineered to provide a current rating of 150 A and a voltage rating of 500V.

* * * * *